US011434858B2

(12) United States Patent
Thomas

(10) Patent No.: US 11,434,858 B2
(45) Date of Patent: Sep. 6, 2022

(54) HERMETICALLY SEALED STATOR COIL

(71) Applicant: Cummins Inc., Columbus, IN (US)

(72) Inventor: Richard D. Thomas, North Vernon, IN (US)

(73) Assignee: CUMMINS INC., Columbus, IN (US)

( * ) Notice: Subject to any disclaimer, the term of this patent is extended or adjusted under 35 U.S.C. 154(b) by 156 days.

(21) Appl. No.: 16/837,304

(22) Filed: Apr. 1, 2020

(65) Prior Publication Data

US 2020/0318591 A1 Oct. 8, 2020

Related U.S. Application Data

(60) Provisional application No. 62/828,716, filed on Apr. 3, 2019.

(51) Int. Cl.

| | |
|---|---|
| ***H01F 3/00*** | (2006.01) |
| ***F02M 51/06*** | (2006.01) |
| ***H01F 7/16*** | (2006.01) |
| ***H01F 7/129*** | (2006.01) |

(52) U.S. Cl.
CPC ..... *F02M 51/061* (2013.01); *H01F 7/129* (2013.01); *H01F 7/1638* (2013.01)

(58) Field of Classification Search
CPC ..... F02M 51/061; F02M 2200/9015; F02M 47/027; F02M 51/066; F02M 63/0019; F02M 63/0022; H01F 7/129; H01F 7/1638; H01F 7/128; H01F 2007/062; H01F 5/02; H01F 5/04; H01F 27/04; H01F 27/2828; H01F 27/29
USPC ..... 335/260
See application file for complete search history.

(56) References Cited

U.S. PATENT DOCUMENTS

| | | | | |
|---|---|---|---|---|
| 3,314,030 | A * | 4/1967 | Mallett | H01F 27/04 174/665 |
| 4,552,311 | A * | 11/1985 | Casey | F02M 51/005 239/585.4 |
| 6,545,583 | B1 * | 4/2003 | Palmer | H01F 7/128 174/152 G |
| 2011/0147495 | A1 * | 6/2011 | Manubolu | F02M 63/0071 239/585.1 |
| 2016/0069312 | A1 * | 3/2016 | Brown | H01F 7/1607 239/585.5 |
| 2018/0183283 | A1 * | 6/2018 | Lucas | H02K 5/10 |
| 2019/0326842 | A1 * | 10/2019 | Omekanda | H02K 7/20 |

(Continued)

FOREIGN PATENT DOCUMENTS

| | | | | |
|---|---|---|---|---|
| JP | 4703697 | B2 * | 6/2011 | F02M 51/06 |

*Primary Examiner* — Shawki S Ismail
*Assistant Examiner* — Lisa N Homza
(74) *Attorney, Agent, or Firm* — Faegre, Drinker, Biddle & Reath LLP

(57) ABSTRACT

A stator coil assembly is provided comprising: a stator having a stator core;

a cover positioned within the stator core; a top section coupled to the cover to define an interior region, the top section including a pair of protrusions, each protrusion having a bore extending therethrough; a bobbin disposed within the interior region; a plurality of coil windings wrapped around the bobbin; a pair of lead wires, each lead wire extending through a corresponding protrusion bore and connecting to the coil windings within the interior region; and a pair of hermetic seals, each hermetic seal surrounding a corresponding lead wire within a protrusion bore to hermetically seal the interior region.

12 Claims, 6 Drawing Sheets

(56) References Cited

U.S. PATENT DOCUMENTS

2020/0203881 A1* 6/2020 Marzano ..... H01G 4/35
2020/0388940 A1* 12/2020 Fukushima ..... H01R 13/533

* cited by examiner

HERMETICALLY SEALED STATOR COIL

CROSS-REFERENCE TO RELATED APPLICATIONS

The present application claims benefit of the filing date of U.S. Provisional Patent Application No. 62/828,716 (filed Apr. 3, 2019, and entitled "HERMETICALLY SEALED STATOR COIL"), the complete disclosure of which is expressly incorporated herein by reference.

FIELD OF THE DISCLOSURE

The present invention relates generally to electromagnetic solenoids and, more particularly, to a hermetically sealed stator coil.

BACKGROUND OF THE DISCLOSURE

Electromagnetic solenoids can be used to actuate fuel injectors to introduce fuel into the cylinders of an internal combustion engine. When a fuel source is electrically conductive (e.g., ethanol or ED95), fluid in both vapor and liquid form may be present in the interior of a potted or molded stator assembly and can provide an undesirable electrically conductive path from the stator coil wires to outside metal parts of the stator. Coils are usually coated with a film that acts as an electrical insulator to avoid this short-circuiting. Electrically conductive fuel sources, however, can attack and degrade the film, which typically protects only against normal diesel fuel. Moreover, cracks in the film can lead to direct electrical connections resulting in electrical shorting. Also, even if the insulating film is intact, hipot failure via dielectric breakdown can occur causing fault circuitry to be triggered in an electric control module, which could shut down the injector bank on which the hipot or direct short circuit failure occurs. Electrical shorting of the stator/fuel injector may also reduce the life of the stator/fuel injector. As such, one aspect of fuel supply systems that has been the focus of designers is the need to produce alternative stator designs that mitigate or prevent the occurrence of electrical shorting. An existing stator design includes a seal plate between a stator assembly and armature to prevent fuel from entering the interior of stator assembly. However, this design increases the size of the injector and reduces the magnetic force from the solenoid. Thus, there is a need for a stator design that protects the coils from damaging fuel without increasing the size of the assembly or substantially affecting the magnetic force.

SUMMARY OF THE DISCLOSURE

In one embodiment, the present disclosure provides a stator coil assembly comprising: a stator having a stator core; a cover positioned within the stator core; a top section coupled to the cover to define an interior region, the top section including a pair of protrusions, each protrusion having a bore extending therethrough; a bobbin disposed within the interior region; a plurality of coil windings wrapped around the bobbin; a pair of lead wires, each lead wire extending through a corresponding protrusion bore and connecting to the coil windings within the interior region; and a pair of hermetic seals, each hermetic seal surrounding a corresponding lead wire within a protrusion bore to hermetically seal the interior region. In one aspect of this embodiment, each of the pair of hermetic seals is formed from one of ceramic or glass. Another aspect further comprises a pair of grommets, each grommet surrounding a corresponding lead wire and a distal end of a corresponding protrusion of the top section. In another aspect, the bobbin is formed from a plastic material. In yet another aspect, the cover is formed from stainless steel. In still another aspect of this embodiment, the cover includes an inner wall, an outer wall and a bottom wall extending between the inner wall and the outer wall. In a variant of this aspect, the top section is welded to a distal end of the inner wall of the cover and a distal end of the outer wall of the cover. Another aspect of this embodiment further comprises an armature positioned below a lower surface of the stator core, wherein the armature moves upward when electrical current is passed through the coil windings. In another aspect, the bobbin includes an upper wall, a lower wall and a central wall, the coil windings being wrapped around the central wall. In a variant of this aspect, the upper wall of the bobbin includes a pair of hollow extensions, each hollow extension being configured to fit within a corresponding protrusion of the top section, the pair of lead wires extending through the pair of hollow extensions.

BRIEF DESCRIPTION OF THE DRAWINGS

The foregoing aspects and other features and advantages of this disclosure, and the manner of attaining them, will become more readily appreciated and the invention itself will be better understood by reference to the following detailed description of embodiments taken in conjunction with the accompanying drawings, wherein.

Figure 1:
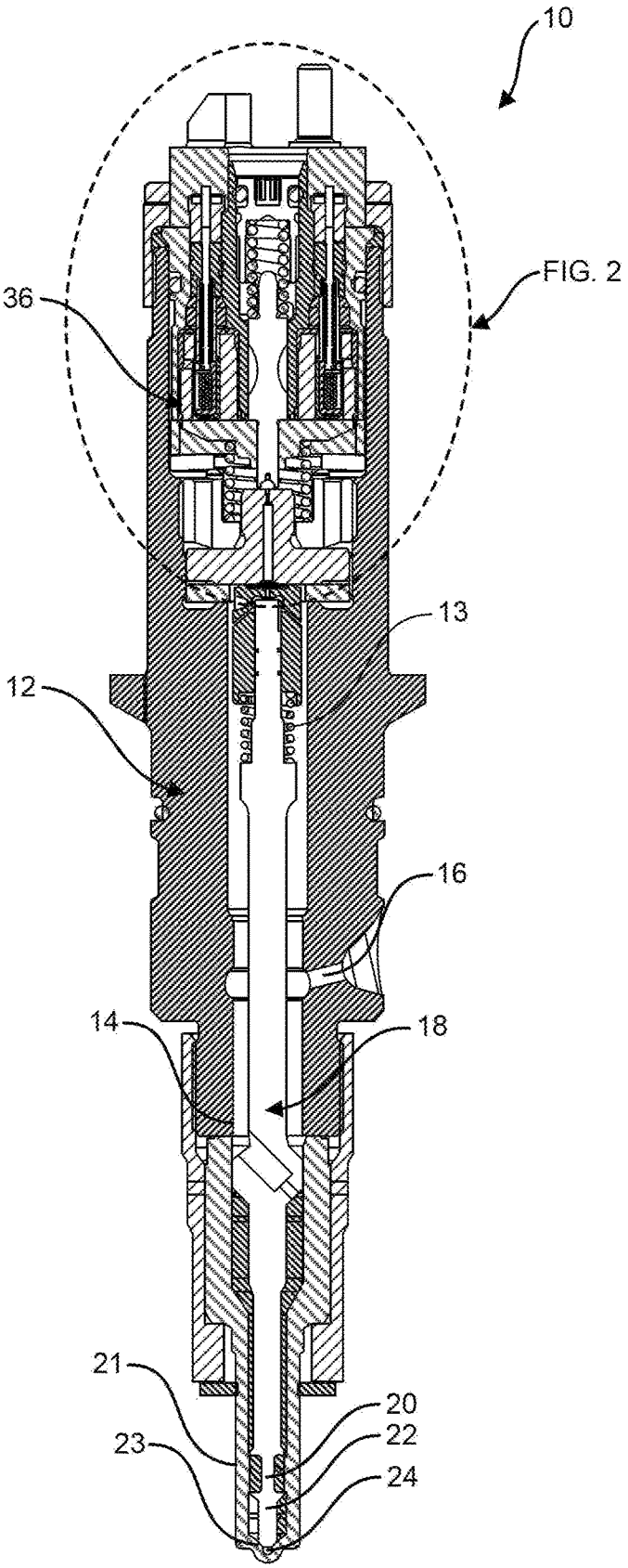
FIG. 1 is a side, cross-sectional view of a fuel injector including a hermetically sealed stator coil assembly in accordance with the present disclosure.

Corresponding reference characters indicate corresponding parts throughout the several views. Although the drawings represent embodiments of various features and components according to the present disclosure, the drawings are not necessarily to scale, and certain features may be exaggerated to better illustrate and explain the present disclosure. The exemplifications set out herein illustrate embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrative devices and described methods and further applications of the principles of the invention which would normally occur to one skilled in the art to which the invention relates.

Referring to FIG. 1, a fuel injector is shown. Fuel injector 10 generally includes a housing 12, a plunger 18 that moves reciprocally within housing 12, a nozzle 21 connected to housing 12, and a solenoid 36 that, when activated, causes plunger 18 to move within housing 12 to control the flow of fuel emitted by injector 10 into a combustion chamber in a manner that is known in the art. Housing 12 includes a fuel inlet 16 where high-pressure fuel enters injector 10 and travels down a passage 14 in housing 12, through a nozzle passage 20 in nozzle 21 toward a nozzle chamber 24 below plunger 18. Plunger 18 and a seating surface 23 in nozzle 21 function as a needle valve 22 which, when plunger 18 engages seating surface 23, is in a closed position, thereby preventing fuel from flowing into nozzle chamber 24 and being emitted from injector 10 through nozzle spray holes (not shown). A spring 13 mounted within passage 14 biases plunger 18 into engagement with seating surface 23. When solenoid 36 is activated, plunger 18 is moved upwardly against the biasing force of spring 13 and the hydraulic force from the pressure in the injector 10, such that plunger 18 moves out of engagement with sealing surface 23, thereby permitting fuel to flow into nozzle chamber 24 and through the nozzle spray holes (not shown) into a combustion chamber of the engine.

Figure 2:
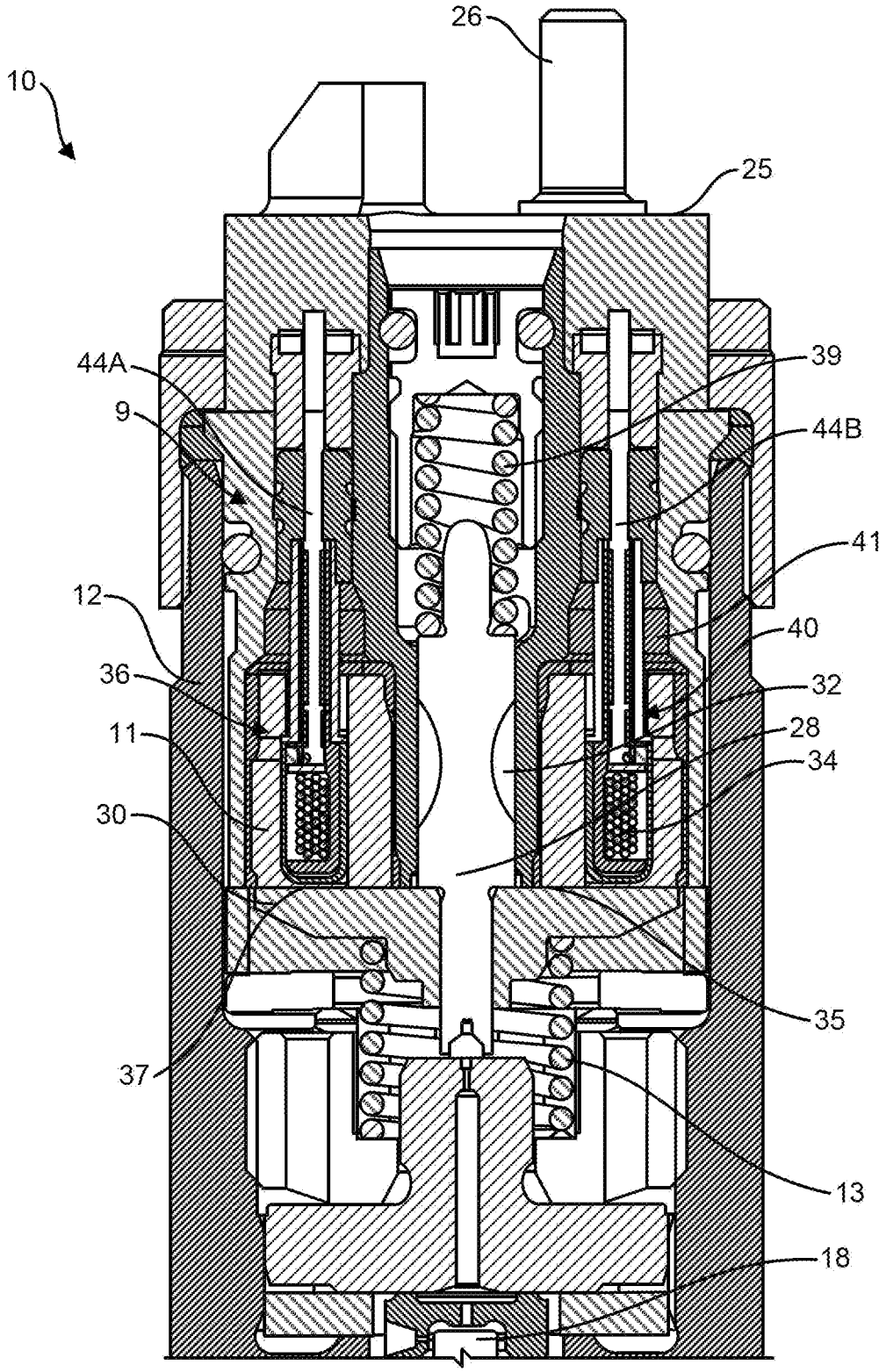
FIG. 2 is an enlarged, side cross-sectional view of a portion of the fuel injector of FIG. 1.

Referring to FIG. 2, solenoid 36 is shown in more detail mounted within injector 10. Solenoid 36 is positioned between housing 12 and a center bore 28. Center bore 28 is configured to accommodate plunger 18 which is moved by an armature 30 in the manner described below. Solenoid 36 includes a stator 9 and a hermetically sealed stator coil assembly 40. The hermetically sealed stator coil assembly 40 includes a plurality of coil windings 34 which connect a lead wire 44A and a lead wire 44B. Each lead wire 44A, 44B extends within a wire guide 41 to a threaded terminal 26 (only one shown in FIG. 2). Threaded terminal 26 extend from a top surface 25 of housing 12 of fuel injector 10 for connection to a power source in a conventional manner. Solenoid 36 is positioned above armature 30. Armature 30 has a pyramid like structure, including a flat contacting surface 37. During operation of solenoid 36, coil windings 34 of stator coil assembly 40 are energized. When coil windings 34 are energized, solenoid 36 acts as an electromagnet which causes armature 30 to move upward under magnetic attraction to solenoid 36.

As armature 30 moves it drives the movement of plunger 18. When armature 30 moves upward, a contact surface 37 of armature 30 contacts a lower surface 35 of stator coil assembly 40, which limits the extent of the upward movement of armature 30. Conversely, when coil windings 34 are de-energized, solenoid 36 and armature 30 are no longer magnetically attracted to each other and armature 30 moves downwardly from stator coil assembly 40 under the force of a spring 39, disengaging from stator coil assembly 40. The movement of armature 30 between its upward position and its downward position defines a stroke gap (not shown). Typically, when the cavity of armature 30 is filled with fuel, the fuel can damage the coil windings 34 and/or stator 9 whether the system is in the upward or downward position. The entire cavity of armature 30 is wetted with drain side fuel. When armature 30 is in the upward position, fuel flows from the high pressure side of the valve (not shown) to the low pressure side and can damage coil windings 34. Stator coil assembly 40 of the present disclosure, however, protects coil windings 34, so the presence of fuel within the armature 30 *t* will not damage coil windings 34. In the illustrated embodiment, coil windings 34 may be made from copper. However, it is contemplated that other suitable electrically conductive materials may be used for coil windings 34.

In certain prior art designs, a barrier or plate is positioned between upper surface 37 of armature 30 and a lower surface 35 of stator coil assembly 40 to prevent potentially damaging fuel from being introduced into solenoid 36 when armature 30 is in its downward position. Such a barrier, while protecting coil windings 34 from short-circuiting from the presence of electrically conductive fuel, creates a permanent space between upper surface 37 and lower surface 35, effectively increasing the stroke gap of armature 30. This increased space substantially enlarges the fuel injector laterally, which is undesirable in certain applications. The increased space also reduces the magnetic force applied to armature 30 by coil windings 34 when solenoid 36 is activated.

Hermetically sealed stator coil assembly 40 according to the present disclosure provides protection for coil windings 34 without requiring a barrier between lower surface 35 of stator coil assembly 40 and upper surface 37 of armature 30, thereby avoiding the disadvantages associated with the increased space required for such a barrier.

Figure 3:
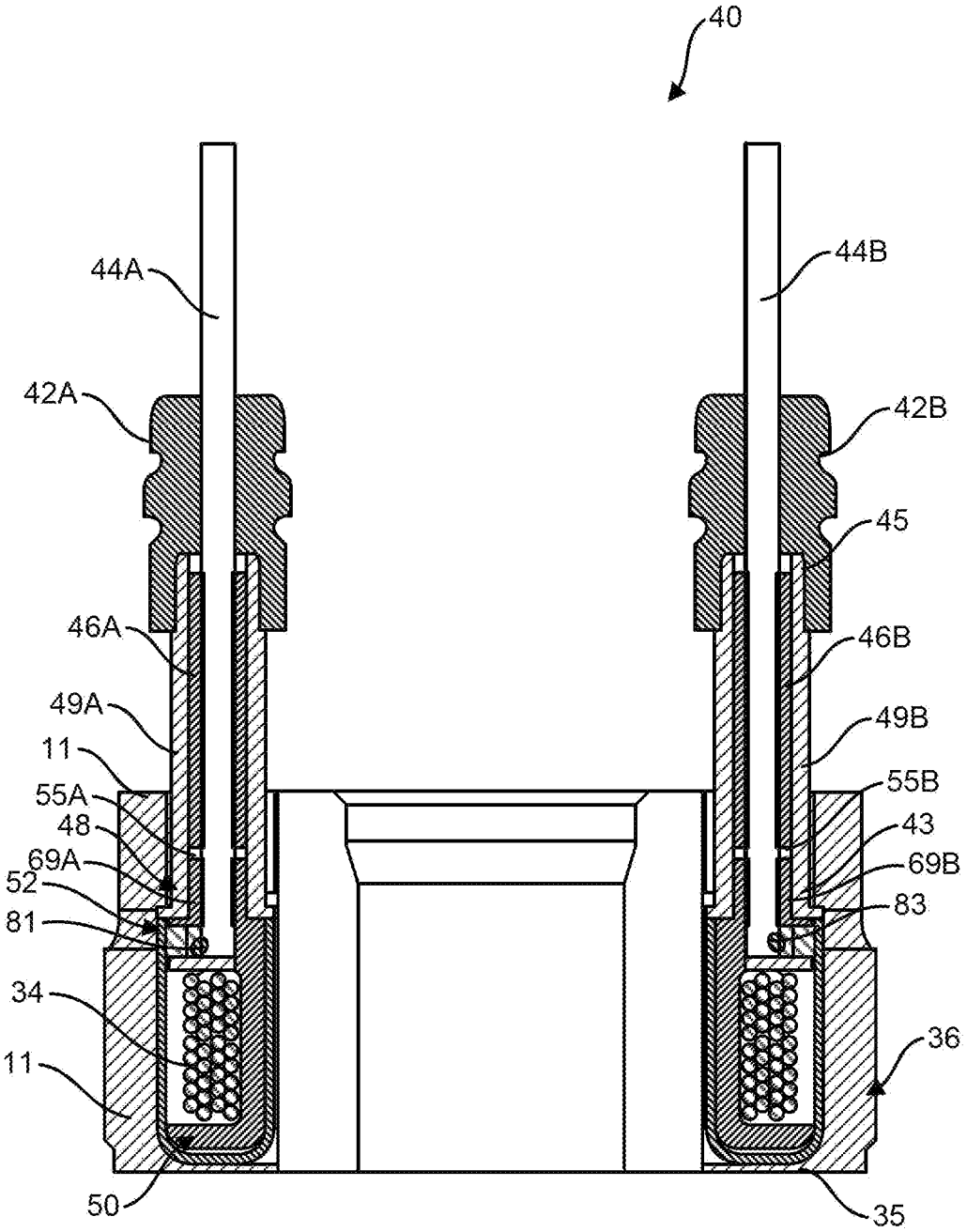
FIG. 3 is a side, cross-sectional view of a partially assembled fuel injector with a hermetically sealed stator coil assembly in accordance with the present disclosure.

As shown in FIG. 3, stator coil assembly 40 generally includes a stator core 11, a top section 48, a bobbin 50, a cover 52, and lead wires 44A, 44B. Stator core 11 surrounds a lower portion 43 of top section 48 and the entirety of bobbin 50 and cover 52 to prevent fuel from contacting coil windings 34. Coil windings 34 connect to lead wire 44A at connection point 81 and to lead wire 44B at connection point 83. As shown, top section 48 includes a pair of protrusions 49A, 49B that extend from lower portion 43 of top section 48. Each protrusion 49A, 49B has a distal end 45. Protrusions 49A, 49B protect lead wires 44A, 44B, respectively, in the manner described herein.

Each lead wire 44A, 44B is surrounded by a seal 46A, 46B respectively. Seals 46A, 46B may be made from ceramic or glass; however, it is contemplated that other suitable materials may be used in alternate embodiments. Seals 46A, 46B may be cylindrical in shape and extend substantially between a distal end 45 and lower portion 43 of top section 48. Distal end 45 of top section 48 is disposed within a wire guide (not shown), while lower portion 43 is disposed within stator core 11. The present embodiment uses a sealing device such as a pair of grommets 42A, 42B configured to seal above the protrusions 49A, 49B respectively, to prevent electrically conductive fuel from rising above the height of the distal end 45 of the top section 48. In this manner, lead wires 44A, 44B are protected and fuel is retained below distal end 45 of top section 48. Alternate sealing devices such as pressure joints or O-rings could be used to create the seal as well.

Figure 4:
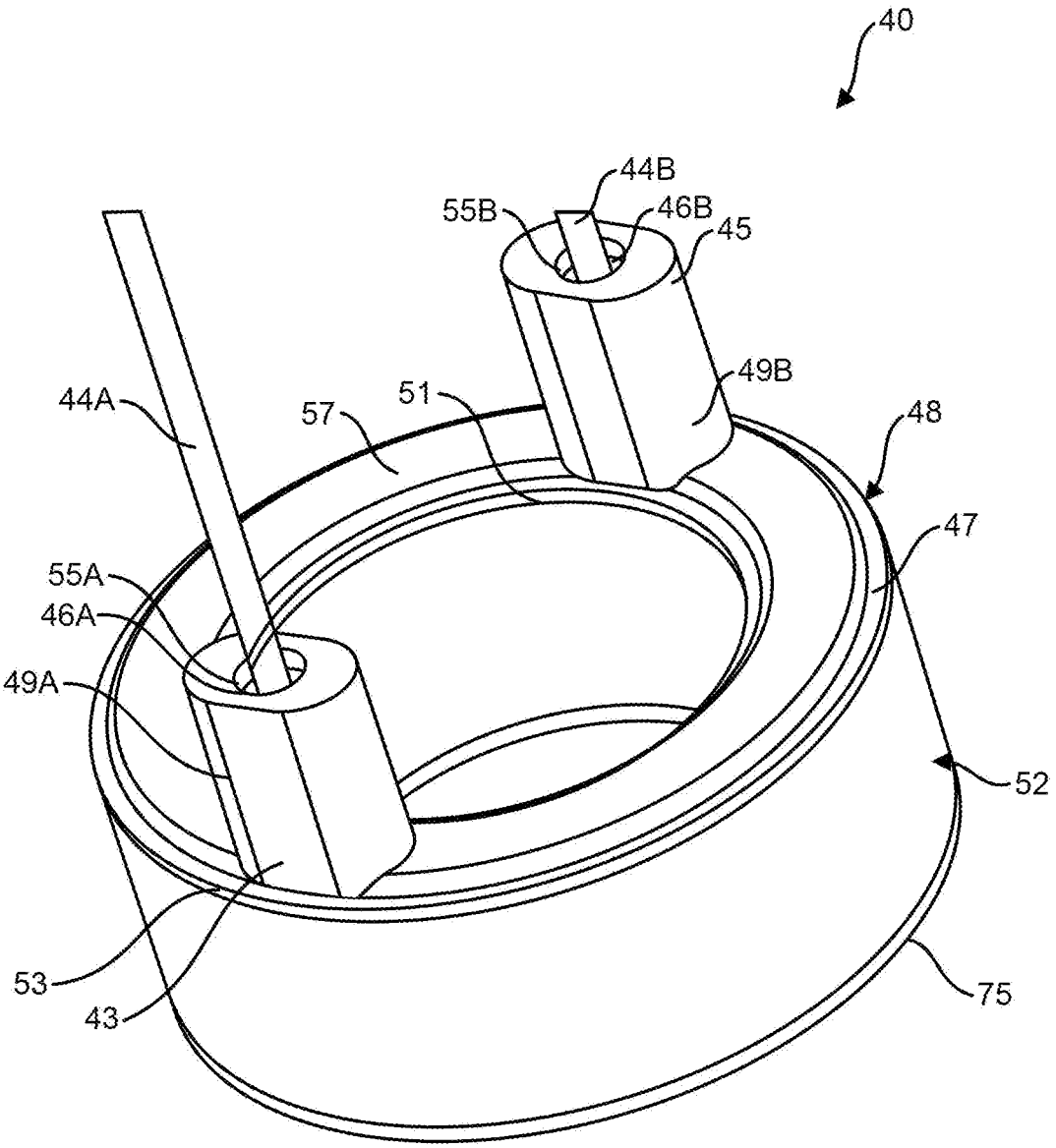
FIG. 4 is a perspective view of a hermetically sealed stator coil assembly in accordance with the present disclosure.
Figure 5:
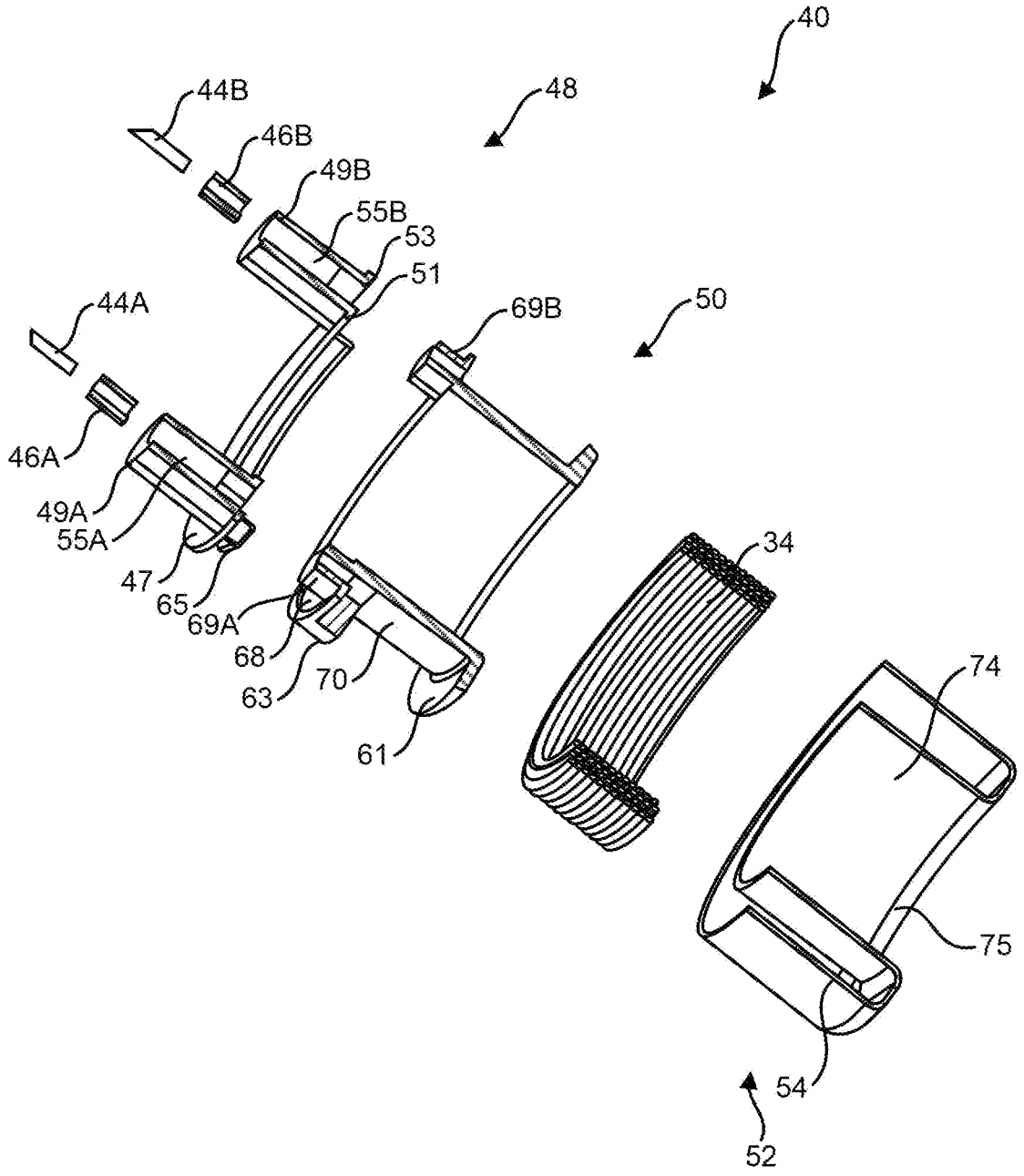
FIG. 5 is an exploded, cross-sectional view of the hermetically sealed stator coil assembly of FIG. 4.

The various components of hermetically sealed stator coil assembly 40 are shown assembled in FIG. 4 and exploded in FIG. 5. Protrusions 49A, 49B each include a cylindrical bore 55A, 55B that extends through the entirety of each protrusion 49A, 49B respectively. Bores 55A, 55B may be formed in various other suitable shapes in alternative embodiments. Bores 55A, 55B are configured to receive seals 46A, 46B respectively. As best shown in FIG. 5, for example, one end of lead wire 44A is enclosed within seal 46A within bore 55A and one end of the other lead wire 44B is enclosed within seal 46B within bore 55B. Top section 48 has a raised ring 57 that extends from top section surface 47. Raised ring 57 is positioned between stator core 11 (not shown) and bobbin 50 (FIG. 5). Top section 48 also includes an inner shoulder 51 and an outer shoulder 53. Inner shoulder 51 extends radially inward from raised ring 57 of top section 48, and outer shoulder 53 extends radially outwardly from raised ring 57.

Referring to FIG. 5, top section 48 further includes a lower portion 65 that extends downwardly from the top section surface 47. Lower portion 65 is configured to fit within a slot 68 formed in bobbin 50. Bobbin 50 includes an upper wall 63 and a lower wall 61 that extend radially outwardly from a central wall 70. Coil windings 34 are positioned between upper wall 63 and lower wall 61 and wrap around central wall 70 of bobbin 50. Bobbin 50 also includes a pair of extensions 69A, 69B that extend from upper wall 63 of bobbin 50 into lower portion 43 of top section 48 as best shown in FIG. 3. More specifically, extensions 69A, 69B fit within bores 55A, 55B of top section 48, respectively. Extensions 69A, 69B are hollow to accommodate lead wires 44A, 44B, respectively. In one embodiment, bobbin 50 is formed from plastic material, but other materials may be suitable in other applications.

Figure 6:
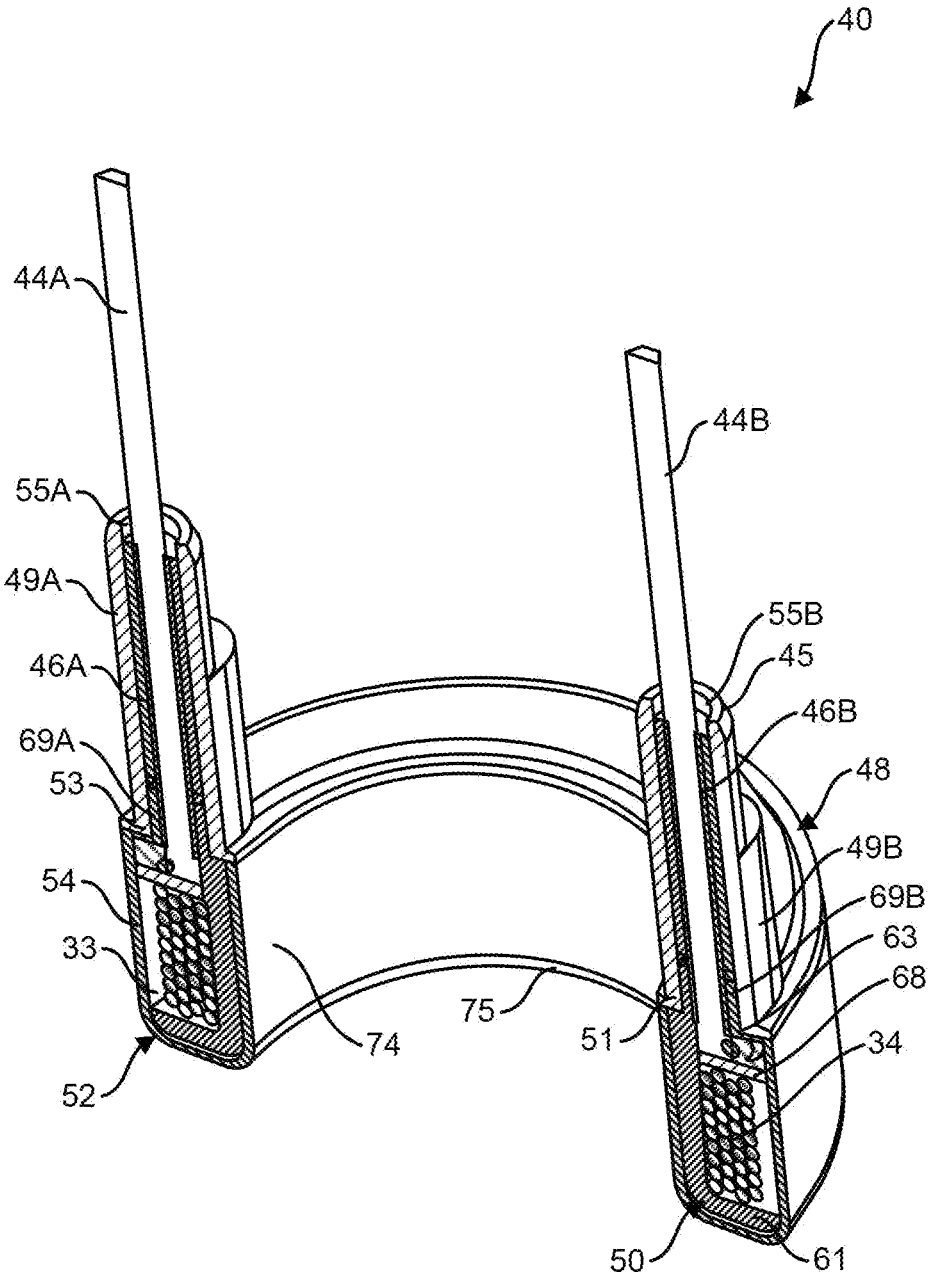
FIG. 6 is a perspective, cross-sectional view of the hermetically sealed stator coil assembly of FIG. 4.

Referring now to FIGS. 5 and 6, cover 52 includes an inside wall 74 and an outside wall 54 connected together at one end by a bottom wall 75. In one embodiment, cover 52 is stamped from a blank of non-magnetic stainless steel, however in other embodiments different materials and forming methods may be used. Outer wall 54 of cover 52 contacts outer shoulder 53 of top section 48. Inner wall 74 of cover 52 contacts inner shoulder 51 of top section 48. In one embodiment, outer wall 54 and inner wall 74 of cover 52 are welded to outer shoulder 53 and inner shoulder 51, respectively. Lower wall 61 of bobbin 50 extends between outer wall 54 and inner wall 74 of cover 52. Inner shoulder 51 and outer shoulder 53 of top section 48 extend around extensions 69A, 69B of bobbin 50 and contact upper wall 63 of bobbin 50. Stator coil assembly 40 creates a hermetic seal around coil windings 34 by enclosing windings 34 within cover 52 and top section 48 and preventing ingress of fuel through bores 55A, 55B using seals 46A, 46B around lead wires 44A, 44B. The connections 81, 83 (FIG. 3) between lead wires 44A, 44B and coil windings 34 are made within a space enclosed by top section 48 and cover 52, which itself is enclosed within stator core 11.

As indicated above, the hermetic seal created by top section 48, cover 52, and seals 46A, 46B prevents electrically conductive fuel (e.g., ethanol or ED95) from entering enclosed region 33 which contains coil windings 34. Such electrically conductive fuel, if allowed to enter enclosed region 33, could provide an electrical path from coil windings 34 to other electrically conductive parts of stator coil assembly 40, thereby shorting coil windings 34 to ground and causing damage to solenoid 36. Additionally, by hermetically sealing stator coil assembly 40 from fuel or fuel vapors in the manner described herein, the air gap between armature 30 and lower surface 35 of assembly 40 is not increased, and therefore does not substantially affect the magnetic attraction force between assembly 40 and armature 30.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practices in the art to which this invention pertains.

What is claimed is:

1. A stator coil assembly comprising:
- a stator having a stator core;
- a cover positioned within the stator core;
- a top section coupled to the cover to define an interior region;
- a bobbin disposed within the interior region, wherein the stator core surrounds a lower portion of the top section and the entirety of the bobbin and the cover;
- a plurality of coil windings wrapped around the bobbin;
- a pair of lead wires, each lead wire extending through a corresponding protrusion bore and connecting to the coil windings within the interior region; and
- a pair of hermetic seals, each hermetic seal surrounding a corresponding lead wire within a bore defined within the top section to hermetically seal the interior region.

2. The stator coil assembly of claim 1, wherein each of the pair of hermetic seals is formed from one of ceramic or glass.

3. The stator coil assembly of claim 1, wherein the bobbin is formed from a plastic material.

4. The stator coil assembly of claim 1, wherein the cover is formed from stainless steel.

5. The stator coil assembly of claim 1, wherein the cover includes an inner wall, an outer wall and a bottom wall extending between the inner wall and the outer wall.

6. The stator coil assembly of claim 5, wherein the top section is welded to a distal end of the inner wall of the cover and a distal end of the outer wall of the cover.

7. The stator coil assembly of claim 1, further comprising an armature positioned below a lower surface of the stator core, wherein the armature moves upward when electrical current is passed through the coil windings.

8. The stator coil assembly of claim 1, wherein the bobbin includes an upper wall, a lower wall and a central wall, the coil windings being wrapped around the central wall.

9. The stator coil assembly of claim 8, wherein the upper wall of the bobbin includes a pair of hollow extensions, each hollow extension being configured to fit within a corresponding protrusion of the top section, the pair of lead wires extending through the pair of hollow extensions.

10. The stator coil assembly of claim 1, wherein the top section includes a pair of protrusions.

11. The stator coil assembly of claim 10, wherein the channel is a protrusion bore within each protrusion.

12. The stator coil assembly of claim 10, further comprising a pair of grommets, each grommet surrounding a corresponding lead wire and a distal end of a corresponding protrusion of the top section.

* * * * *